United States Patent [19]

Paquin

[11] Patent Number: 4,760,947

[45] Date of Patent: Aug. 2, 1988

[54] SLITTER STRAND SEPARATING ROLL

[75] Inventor: Ronald J. Paquin, Elginburg, Canada

[73] Assignee: Alcan International Limited, Kingston, Canada

[21] Appl. No.: 788,758

[22] Filed: Oct. 18, 1985

[30] Foreign Application Priority Data

Oct. 31, 1984 [CA] Canada ..... 466757

[51] Int. Cl.[4] ..... B65H 20/00

[52] U.S. Cl. ..... 226/190

[58] Field of Search ..... 226/15, 88, 190, 193

[56] References Cited

U.S. PATENT DOCUMENTS

| | | | |
|---|---|---|---|
| 1,005,801 | 10/1911 | Birch | 26/99 |
| 2,042,010 | 5/1936 | Lewis | 26/63 |
| 2,592,581 | 4/1952 | Lorig | 271/2.6 |
| 2,717,037 | 9/1955 | Goodwillie | 226/190 X |
| 2,772,879 | 9/1953 | Lorig | 271/2.6 |
| 3,339,818 | 9/1967 | Morrow | 226/190 |
| 3,405,855 | 10/1968 | Daly et al. | 226/193 X |
| 3,637,063 | 1/1972 | Ward | 198/29 |
| 4,021,894 | 5/1977 | Poterala et al. | 26/105 |

FOREIGN PATENT DOCUMENTS

| | | | |
|---|---|---|---|
| 663143 | 4/1965 | Belgium | 226/190 |

OTHER PUBLICATIONS

Theory and Application of Lorig-Aligner, Midland--Ross Corporation.

*Primary Examiner*—Daniel P. Stodola
*Attorney, Agent, or Firm*—Cooper & Dunham

[57] ABSTRACT

An apparatus is described for separating a plurality of immediately adjacent strands of metallic sheet severed from a continuous moving flexible metallic sheet, e.g. aluminum sheet. The apparatus includes a rotatable roll over which the adjacent strands pass, this roll having a resilient outer periphery. A plurality of radial slots are formed in the resilient periphery, forming annular resilient rings therebetween. These slots are laterally spaced and are inclined inwardly toward the axis of the roll and toward the transverse central plane of the roll. The slots are of progressively increasing depths from the transverse central plane of the roll to the outer ends thereof. The annular resilient rings so formed are adapted to provide separations between adjacent strands when the strands are maintained at a constant wrap angle on the separating roll.

7 Claims, 2 Drawing Sheets

SLITTER STRAND SEPARATING ROLL

BACKGROUND OF THE INVENTION

This invention relates to an apparatus for separating a plurality of immediately adjacent strands of metallic sheet severed from a continuous moving flexible metallic sheet, such as aluminum sheet.

In the production of aluminum products, it is commonplace to prepare a large mill coil of aluminum sheet. This large coil is then uncoiled and slit into a number of strands and the adjacent strands thus formed are recoiled into a series of new coils. Typically about 2 to 6 slits are made in an aluminum sheet to produce a plurality of adjacent strands.

After slitting, it is necessary to introduce some separation between slit coils when they are rewound so that the edges do not interweave or butt each other to produce belled edges. Traditionally, separation is achieved with about a 20 ft. unsupported strand length between the slitter head and rewind, with tapered steel discs being forced between the strands to establish the necessary fan-out. Narrow strands offer little resistance to the lateral shift controlled by the discs, but resistance increases with width and a split becomes more difficult to separate. When the resistance to shift becomes greater than the yield stress of the slit material, the result is a ripple or other strip edge damage. Various mechanical devices have been tried over the years to separate split coils, but most systems have been expensive or bulky, have been sensitive to the production of edge ripple and have required considerable operator skill and time to adjust.

Strip "profile" is common to all rolled stock and manifests itself in a slightly thicker, e.g. 1 to 2% thicker, section in the central area than at the edges. Since profile is nearly always symmetrical, a centre split coil will produce two strands of equal length. However, as the number of slit strands increases, the different strand lengths resulting from the different profiles become apparent as lost tension during strand buildup on the re-coil.

Roll devices are known which include automatic centering means for belts and one such device is described in Lorig, U.S. Pat. No. 2,772,879, issued Dec. 4, 1956. That device includes a roll with radial separations to provide laminations. These are inclined radially towards the axis of the roll away from the transverse centre line thereof.

It is an object of the present invention to provide a roll device which is capable of laterally separating a plurality of strands slit from a continuously moving flexible metallic sheet.

SUMMARY OF THE INVENTION

According to this invention, there is provided an apparatus for separating a plurality of immediately adjacent strands of metallic sheet severed from a continuous moving flexible metallic sheet, e.g. aluminum sheet. The apparatus includes a rotatable roll over which the adjacent strands pass, this roll having a resilient outer periphery. A plurality of radial slots are formed in the resilient periphery, forming annular resilient rings therebetween. These slots are laterally spaced and are inclined inwardly toward the axis of the roll and toward the transverse central plane of the roll. The slots are of progressively increasing depths from the transverse central plane of the roll to the outer ends thereof. The annular resilient rings so formed are adapted to provide separations between adjacent strands when the strands are maintained at a constant wrap angle on the separating roll.

The slots of progressively increasing depths from the transverse central plane of the roll to the outer ends thereof have the special advantage of making it possible to separate from each other a plurality of severed strands. Thus, while the apparatus is effective for separating two strands, it is particularly effective for separating from each other 3 to 6 strands severed from a coil.

Strands exerting a normal force on the separating roll will compress the resilient rings. The increasing slot depth allows an increasing lateral shift to separate 2 or several slit strands without the need for conventional separator discs.

DESCRIPTION OF THE PREFERRED EMBODIMENTS

The separate strands moving over the separator roll are sensitive to tension changes. A strand without tension will allow the resilient rings to return to their rest position and a condition of no separation may result. According to a preferred embodiment, a stabilizing roll is utilized to buffer the influence of tension changes and maintain a constant wrap angle on the separating roll. Since strands passing over a roll tend to depart on a path perpendicular to the roll axis, a flat stabilizing roll has the effect of containing the path of the separated strands.

In the accompanying drawings illustrating a preferred embodiment of the invention:

Figure 1:
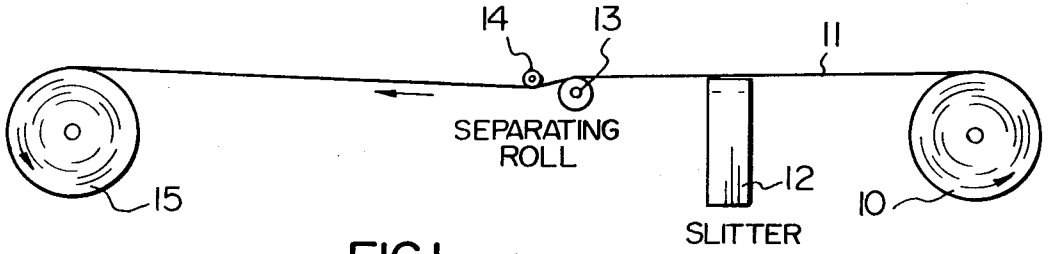
FIG. 1 is an end elevation of a coil slitter system with the separating roll of the invention.
Figure 2:
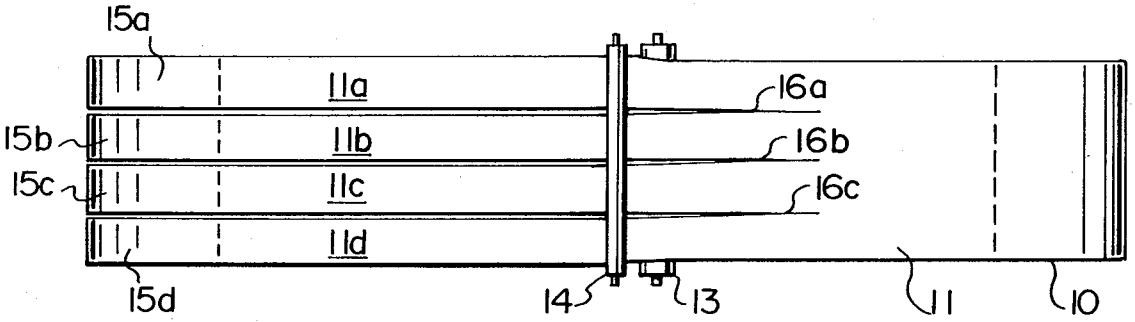
FIG. 2 is a top plan view of the arrangement shown in FIG. 1.

Referring more particularly to FIGS. 1 and 2 of the drawings, the reference numeral 10 indicates a mill coil of aluminum sheet. A strip 11 of aluminum sheet is uncoiled from coil 10 and passes through a slitter 12 where it is divided by way of slits 16*a*, 16*b* and 16*c* into strands 11*a*, 11*b*, 11*c* and 11*d*.

Figure 3:
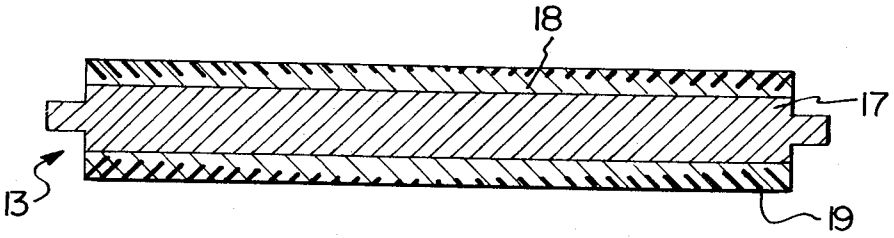
FIG. 3 is a transverse sectional view of the separating roll of the invention.
Figure 4:
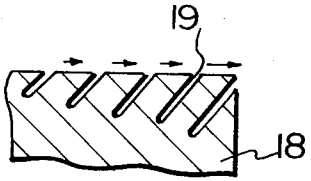
FIG. 4 is a sectional view showing details of the separating roll slots.

The strands 11*a*–11*d* pass over a separating roll 13 and beneath a stabilizing roll 14 and are re-coiled by re-coiler 15 into a plurality of coils 15*a*, 15*b*, 15*c* and 15*d*. The separating roll 13, which is positioned as close to the rewind 15 as is practically possible, is shown in greater detail in FIGS. 3 and 4. As can be seen particularly in FIG. 3, the roll has a central core portion 17 around which is provided a resilient peripheral portion 18. This resilient peripheral portion is preferably made of polyurethane, e.g. polyurethane having about a 60–75 Shore "A" hardness, although softer and harder materials may be used.

A series of spaced, radial slots 19 are cut into the polyurethane 18 and these slots are inclined inwardly towards the axis of the roll and towards the transverse central plane of the roll. The incline of the slots is preferably about 45° to the axis of the roll with a resilient material having a Shore "A" hardness of 65–70, and usually within the range of about 30° to 60°, depending upon the hardness of the resilient material.

The slots are of progressively increasing depths from the transverse central plane of the roll to the outer ends thereof and they preferably start near the transverse central plane with depths of about 0.15 inch, reaching depths in the order of 0.75 inch at the outer ends. Although there is a general progression of increasing depths, there is no harm in having several adjacent slots of equal depths. Each radial slot typically has a width of about 0.05 to about 0.08 inch and the slots are normally laterally spaced by about 0.5 inch.

Figure 5:
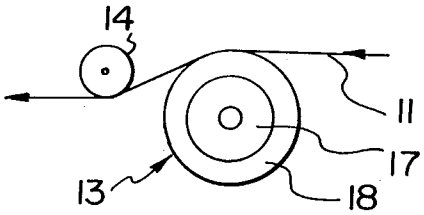
FIG. 5 is an end elevation showing the arrangement of the separating roll and the stabilizing roll.

As mentioned above, it is important to maintain a constant wrap angle on the separating roll 13. This is achieved by means of the stabilizing roll 14 positioned as shown in FIG. 5. In a typical commercial installation, the separating roll 13 has a diameter of about 10 inches, while the stabilizing roll has a diameter of about 6 inches.

As the slit strands 11 come into contact with the roll 13 and press against it, they deform the polyurethane rings between the radial slots 19. Since the slots are of increasing depths, the polyurethane rings are also of increasing radial depths. At the same applied pressure the polyurethane rings will progressively deflect further laterally with increasing slot depths. The result is an increasing lateral shift of the surface of the separating roll in the direction of the increasing slot depths. This causes the slit strands pressing against the separating roll to correspondingly shift laterally whereby the strands laterally separate from each other.

While certain preferred embodiments of the invention have been shown and described, it will be apparent that other adaptations and modifications may be made without departing from the scope of the following claims.

I claim:

1. Apparatus for separating a plurality of immediately adjacent strands of metallic sheet severed from a continuous moving flexible metallic sheet comprising:

a rotatable roll over which the adjacent strands pass, said roll having a resilient outer periphery, with a plurality of radial slots formed in said resilient periphery forming resilient annular rings therebetween, said slots being laterally spaced and being inclined inwardly toward the axis of the roll and toward the transverse central plane of the roll and said slots being of progressively increasing depths from the transverse central plane of the roll to the outer ends thereof, with said resilient rings being adapted to provide separations between adjacent strands when the strands are maintained at a constant wrap angle on the separating roll; and a stabilizing roll under which the separated strands pass, said stabilizing roll being positioned to maintain a constant wrap angle of the strands on the separating roll.

2. An apparatus according to claim 1 wherein several adjacent radial slots have the same depths.

3. An apparatus according to claim 1 wherein the radial slots have depths varying between about 0.15 and 0.75 inch.

4. An apparatus according to claim 3 wherein each radial slot has a width of about 0.05 to about 0.08 inch, the slots have depths varying between about 0.15 and 0.75 inch and the slots are laterally spaced by about 0.5 inch.

5. An apparatus according to claim 3 wherein the slots are inclined at an angle of about 30° to about 60° relative to the axis of the roll.

6. An apparatus according to claim 3 wherein the resilient material is a polyurethane having a Shore "A" hardness of about 60–75.

7. An apparatus according to claim 1 wherein the resilient material is a polyurethane.

* * * * *